United States Patent [19]

Pasquini

[11] 4,395,953

[45] Aug. 2, 1983

[54] RAILWAY TRACK TAMPING MACHINE

[75] Inventor: Sandro Pasquini, La tour-de-Peilz, Switzerland

[73] Assignee: Sig Societe Industrielle Suisse, Neuhausen-Chutes du Rhin, Switzerland

[21] Appl. No.: 226,183

[22] Filed: Jan. 19, 1981

[30] Foreign Application Priority Data

Feb. 19, 1980 [CH] Switzerland ..... 1327/80

[51] Int. Cl.[3] ..... E01B 27/17

[52] U.S. Cl. ..... 104/7 R; 104/12

[58] Field of Search ..... 104/2, 7 R, 7 A, 7 B, 104/8, 12; 105/26 R, 133

[56] References Cited

U.S. PATENT DOCUMENTS

| | | | |
|---|---|---|---|
| 2,045,510 | 6/1936 | Armington | 105/133 X |
| 3,238,896 | 3/1966 | Minenko et al. | 105/26 R |
| 3,339,493 | 9/1967 | Bryan, Jr. | 104/7 R |
| 3,576,166 | 4/1971 | Bollmann | 105/133 X |
| 4,186,665 | 2/1980 | de Jong et al. | 105/26 R X |

FOREIGN PATENT DOCUMENTS

| | | | |
|---|---|---|---|
| 614475 | 11/1979 | Switzerland | 104/12 |

*Primary Examiner*—Randolph Reese

*Attorney, Agent, or Firm*—Hedman, Casella, Gibson, Costigan and Hoare

[57] ABSTRACT

A tamping machine having a chassis mounted on two trucks and track displacement tools as well as tamping tools arranged on the chassis between the two trucks is disclosed. On the front part of the chassis, two cabs are installed on opposite sides of a power plant arranged on the chassis, and the rear portion of this chassis is free of any superstructure. The first cab has a first driving station and a station for displaying and setting the track displacement values overlooking the front of the tamping machine, and the second cab has a second driving station overlooking the rear of the machine and a tamping operator station overlooking the track displacement tools and tamping tools. The control stations are thus grouped in two cabs at their optimum locations.

3 Claims, 4 Drawing Figures

RAILWAY TRACK TAMPING MACHINE

The object of the present invention is a railway track tamping machine, which is intended to assure simultaneously the tamping of the track and the correction of the position of the track as the machine advances in its work.

On railway track tamping machines, the positions of the tamping and track displacements tools as well as the positions of the control stations have varied in time as a function of the development of the working techniques and of the requirements with regard to the driving of the machine and the safety of the operators.

On modern tamping machines having tools arranged between their rolling supports, the trend is towards the installation of two cabs, one at the front and the other at the rear referred to the direction of advance in operation, each equipped with a driving station, so as to provide the driver with perfect visibility of the track in both directions of travel of the machine traveling to and from the work site.

During advance in operation, from the front cab the operator in charge of posting and verifying the prescribed values for the displacement of the track can easily observe from his station certain of these values which are entered on the track and post them.

From the rear cab, which is closer to the tamping tools the tamper operator can control and verify from his station the positioning and work of these tools as well as of the track displacement tools through a window which provides a view towards the front of all these tools.

However, in this configuration the track displacement tools, which are located in a low position at the level of the rails, are partially concealed from the sight of the tamper operator by the frames and the tool holders of the tamping tools located in intermediate position. This drawback is further aggravated on tampers provided with double tamping heads of large size. On so-called universal tamping machines intended furthermore, for the tamping and the displacement of switches and crossings this drawback becomes an unacceptable disturbance to the tamping machine operator since upon each forward step of the tamping machine he must, from a distance, displace the rail grasping hooks so as to avoid the lateral obstacles of said switches and crossings and then direct them towards accessible engagement. In order to carry out these operations better, a close and perfectly clear view of these tools, as would be desirable, cannot be obtained on these machines.

Certain manufacturers of tamping machines have provided a solution to this problem of visibility of the track displacement tools by providing a third cab, reserved solely for the tamper's station, just in front of these tools, from which there is obtained a sufficiently free view of the tamping tools. This solution, which fully satisfies existing requirements with regard to the optimalizing of the location of the control stations is, however, expensive since in addition to the installation of this third cab itself, the cab must be equipped with individual access and air-conditioning means as well as means of communication with the two other cabs.

It is an object of this invention to provide in a tamping machine another solution for the above problems relating to visibility of the track and the tools which makes it possible to avoid the installing of a third cabin and the disadvantages resulting therefrom.

Further objects and advantages of the invention will be apparent from the following description.

The accompanying drawing illustrates the development of the prior art and shows, as example, two embodiments of the object of the invention.

In these four figures, the direction of advance in operation is indicated by the arrow.

Figure 1:
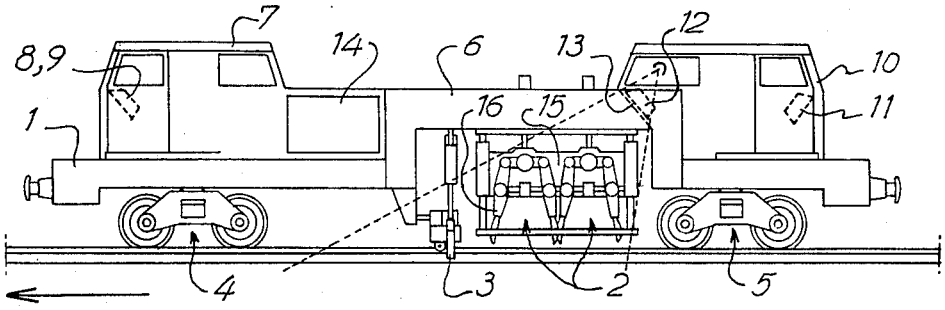
FIG. -1 PRIOR ART
FIGS. 1 and 2 are views in elevation of two known tamping machines.

The tamping machine shown in FIG. 1 is of the type of those first-mentioned above.

This tamping machine has a chassis 1 equipped with double-head tamping tools 2 and track displacement tools 3 arranged between two trucks 4 and 5 under a bridge part 6.

A first cab 7 is installed on the front portion of the chassis 1. This front cab has a first driving station 8 which provides a view of the track in front of the chassis 1 and also a station 9 for posting and verifying the required track displacement values. This station 9 forms part, in customary manner, of a device controlling the amplitude of the displacements of the track effected at the level of the displacement tools 3.

The power plant 14 of this tamping machine, which provides the power necessary for the traction of the machine and for the operation of its tools, is installed between the front cab 7 and the tools 2 and 3.

On this tamping machine the displacement tools 3 are partially hidden by the chassis 15 and the tool holders 16 of the tamping tools 2.

Figure 2:
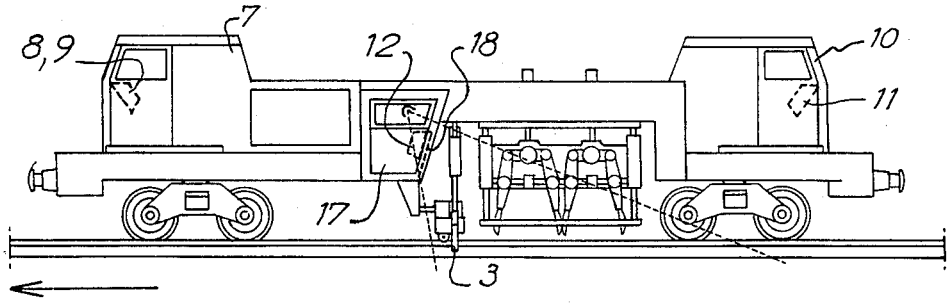
FIG. -2 PRIOR ART

The tamping machine shown in FIG. 2 is of the second type mentioned, in which a third cab 17 which is lowered and reserved solely for the station 12 of the tamping operator, is arranged just in front of the displacement tools 3 so as to provide the tamping operator with a close and clear view of these tools through a front window 18, as well as a sufficient view of the tamping tools 2.

Figure 3:
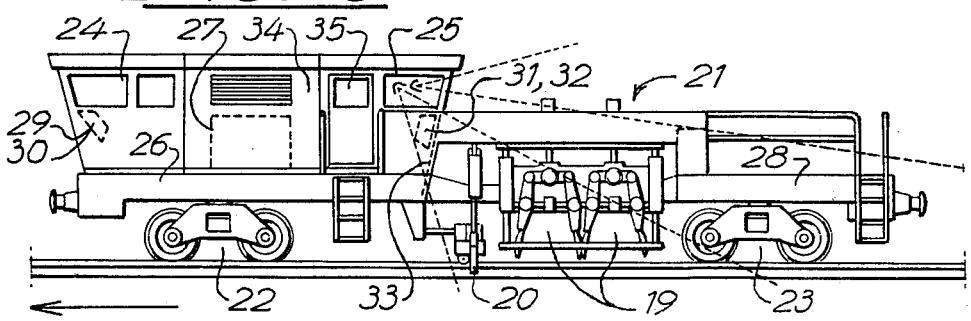
FIGS. 3 and 4 are views in elevation of the two embodiments given by way of example.
Figure 4:
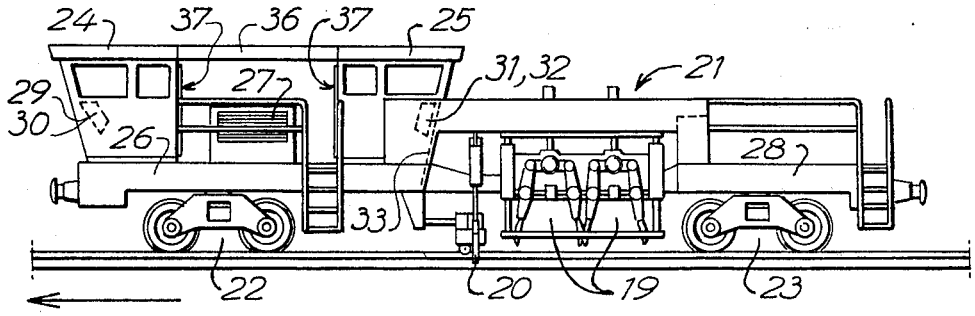

The tamping machine of the invention, two embodiments of which are shown in FIGS. 3 and 4, comprises, like the preceding ones, double-head tamping tools 19 and track displacement tools 20 arranged on its chassis 21 between two trucks 22 and 23. This tamping machine, on the other hand, has only two cabs 24 and 25, installed on the front portion 26 of its chassis 21, in front of the displacement tools 20.

The power plant 27 of this tamping machine is installed between the two cabs 24 and 25, and the rear portion 28 of the chassis 21 is lowered and treated here as a loading platform.

The first cab 24, at the front of the chassis 21, comprises a first driving station 29 and a station 30 for the display and adjustment of the prescribed track displacement values providing a view of the track in front of the chassis, while the second cab 25 comprises a second driving station 31 which gives a view over the track to the rear of the chassis which is free of any superstructure on its rear portion 28, and a tamping-operator station 32 giving a view through a lowered front window 33 of the displacement tools 20 as well as of the tamping tools 19.

Aside from these common points which the two embodiments shown have, the differences reside within the overall arrangement consisting of the two cabs and the power plant.

In the embodiment shown in FIG. 3, the power plant 27 is integrated in a compartment 34 which connects the two cabs 24 and 25 and forms with them a cell to which the personnel of the tamping machine can have access from each side of the track through a side door 35 and can move from one cab to the other along the power plant. This first embodiment which combines all the control stations on both sides of the power plant in a single cell is advantageous for purposes of air conditioning in countries having a very cold climate.

In the embodiment shown in FIG. 4, the power plant 27 is installed under an open-air hood beneath a roof element 36 which connects the two cabs, on the chassis which forms an access platform. The access to each of the two cabs is obtained through a front door 37 opening onto said platform. This second embodiment is advantageous for hot countries and furthermore satisfies the desire of certain railroad systems which, for reasons of safety, look with disfavor on or forbid access through side doors on these machines.

Aside from these two embodiments other arrangements of the cab/power plant assembly can be conceived of.

Thus, for instance, in the first embodiment, shown in FIG. 3, each cab may be equipped with an independent access door and, in the second embodiment, shown in FIG. 4, the power plant can be placed against the front wall of one of the two cabs and the entrance door of said cab can be placed off-center on said wall.

The two cabs 24 and 25 as well as the compartment 34 of the power plant can be formed of removable modular elements so as to facilitate the removal and maintenance of the power plant as well as adaptation of the cabs to the particular conditions of use of each railway system.

Finally, a station for verifying the actual displacements of the track obtained after tamping can also be installed in one of the two cabs, in addition to the four stations mentioned.

What is claimed is:

1. A railway track tamping machine comprising:

(a) a rolling chassis having a front portion and a rear portion, said rear portion being free of superstructure and the front and rear of the chassis being considered with respect to the working direction of advance of the machine;

(b) two rolling support means for said chassis;

(c) displacement tool means for the displacement of the track, said displacement tool means arranged in said chassis between said rolling support means;

(d) tamping tool means for the tamping of the track, said tamping tool means being arranged in said chassis between said rolling support means, said tamping tool means being located behind said displacement tool means with respect to the working direction of advance of the machine;

(e) first cab means to afford view over the track in front of said rolling chassis, said first cab means being arranged at the front portion of said rolling chassis, before said displacement tool means with respect to said working direction of advance;

(f) at least a first driving station and a station for setting and posting prescribed values for the displacement of the track, said stations located within said first cab means;

(g) a second cab means also being arranged at the front portion of said rolling chassis, before said displacement tool means with respect to said working direction of advance;

(h) at least a second driving station and a station for controlling the tamping and displacement tool means, said stations located within said second cab means; and (i) a power plant means arranged between said first and second cab means, whereby from said second cab means view is simultaneously assured first on the displacement tool means, second on the tamping tool means, and third on the track behind the rear portion of the chassis.

2. A railway tamper according to claim 1, wherein the power plant means is integrated in a compartment connecting the two cab means and forming therewith a cell in which all the control stations are grouped.

3. A railway tamper according to claim 1, wherein said rolling chassis forms a platform, wherein said power plant means is installed in the open air on said platform under a roof means, wherein said roof means connects the two cab means, and wherein each of the two cab means comprises an access front door opening onto said platform.

* * * * *